United States Patent [19]

Kettleson

[11] 4,021,038

[45] May 3, 1977

[54] COMPACT GOLF CLUB ASSEMBLY

[76] Inventor: Russell W. Kettleson, 17386 Five Points, Detroit, Mich. 48240

[22] Filed: Feb. 9, 1976

[21] Appl. No.: 656,344

[52] U.S. Cl. ..... 273/80.1; 273/81.2; 280/40; 403/108

[51] Int. Cl.[2] ..... A63B 53/02

[58] Field of Search ..... 273/77 R, 77 A, 80 D, 273/80.1, 81.2; 403/107, 108, 324, 328, 349

[56] References Cited

UNITED STATES PATENTS

| | | | |
|---|---|---|---|
| 1,895,369 | 1/1933 | Blatz | 273/81.2 |
| 2,243,190 | 5/1941 | Capaldo | 403/108 X |
| 2,546,299 | 3/1951 | Du Mais et al. | 403/108 X |
| 2,896,982 | 7/1959 | Wallace | 403/108 |
| 2,921,326 | 1/1960 | Lautmann | 273/81.2 X |
| 3,430,456 | 3/1969 | Stricker | 403/108 X |
| 3,446,523 | 5/1969 | Little | 403/108 |
| 3,816,009 | 6/1974 | Schenk | 403/108 |
| 3,848,737 | 11/1974 | Kenon | 273/80.1 X |
| 3,891,212 | 6/1975 | Hill | 273/80.1 |

*Primary Examiner*—Richard J. Apley
*Attorney, Agent, or Firm*—Charles W. Chandler

[57] ABSTRACT

A golf cart and club assembly which can be collapsed to occupy only a fraction of the volume of conventional, commercial bag and club assemblies.

4 Claims, 7 Drawing Figures

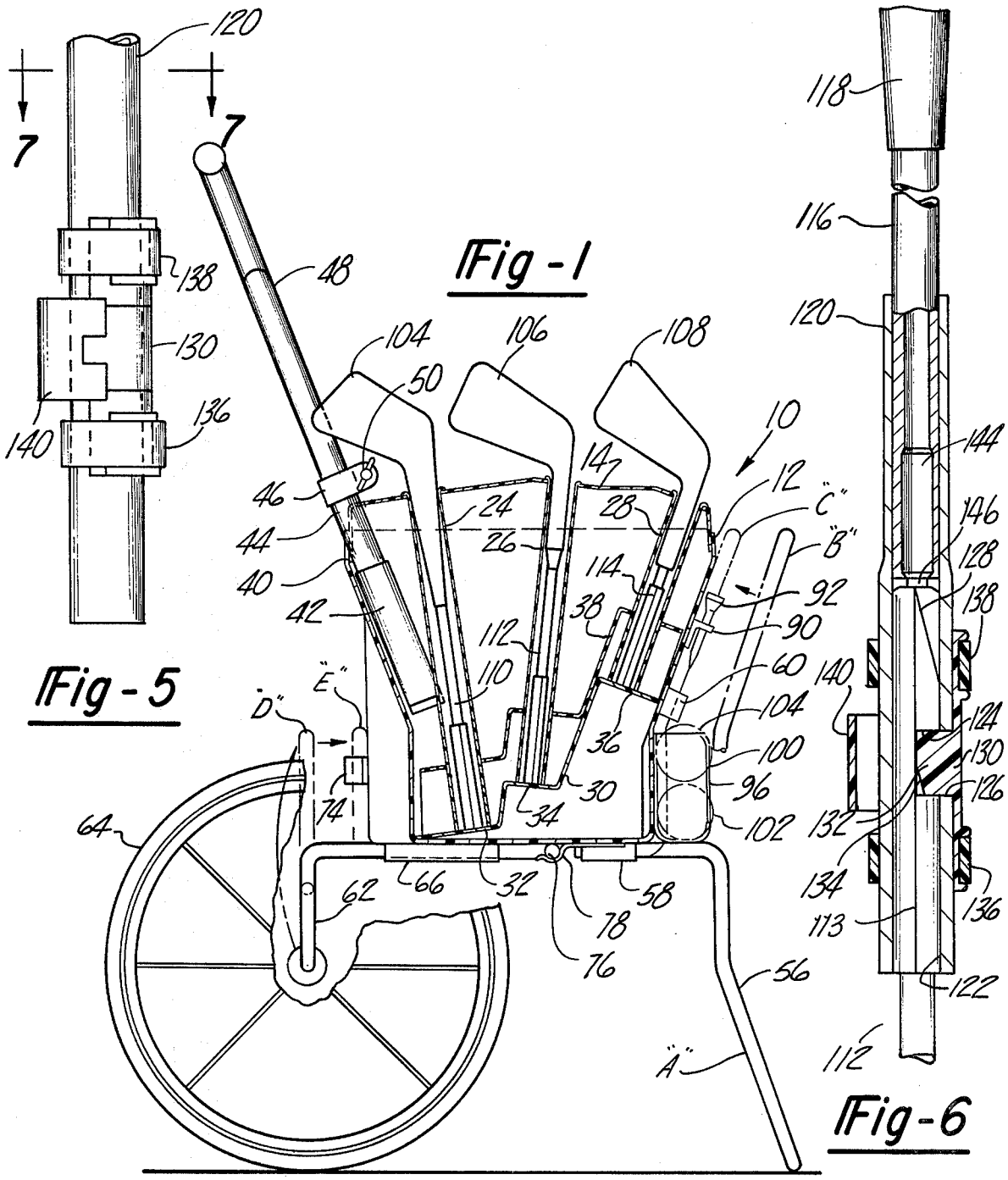
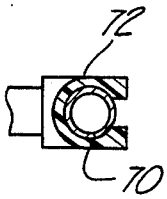
Fig-4
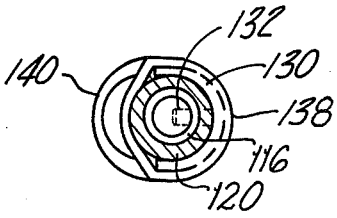
Fig-7

COMPACT GOLF CLUB ASSEMBLY

BACKGROUND OF THE INVENTION

This invention is related to golf cart and club assemblies and more particularly to a collapsible golf cart adapted to carry a set of interchangeable golf heads, each of which can be connected to a common shaft.

Conventional golf bags have a height accommodating the length of a full size golf club. The combined overall length of the bag and the clubs is such that they are cumbersome and difficult to store in the trunk of compact automobiles.

The prior art discloses golf clubs in which a shaft can be connected to a set of interchangeable heads depending on the nature of the stroke that the golfer is planning. Such interchangeable clubs have not achieved significant commercial success. Pertinent prior art includes U.S. Pat. No. 1,946,134 to W. L. Dyce; U.S. Pat. No. 782,955 to Emens; and U.S. Pat. No. 3,206,205 to G. H. McLaghlin.

SUMMARY OF THE INVENTION

One of the broad purposes of the present invention is to provide a golf club having a head which is detached by pressing a button to release the head from the end of the shaft.

Another purpose of the present invention is to provide a golf cart for carrying a set of detachable heads.

Still another object of the invention is to provide a cart having removable wheels and an axle that can be folded to reduce the overall volume of the storage space necessary to accommodate the cart.

Still further objects and advantages of the invention will become apparent to those skilled in the art to which the invention pertains upon reference to the following detailed description.

DESCRIPTION OF THE DRAWINGS

The description refers to the accompanying drawing in which like reference characters refer to like parts throughout the several views, and in which:

FIG. 1 is a side sectional view of a golf cart and club assembly illustrating the preferred embodiment of the present invention;

FIG. 4 is a fragmentary view taken along lines 4—4 of FIG. 2;

FIG. 5 is a enlarged fragmentary view of the means for locking a typical head to the shaft;

FIG. 6 is a longitudinal sectional view of the locking means of FIG. 5; and FIG. 7 is a sectional view as seen along lines 7—7 of FIG. 5, with the detent means removed for clarity.

DESCRIPTION OF THE PREFERRED EMBODIMENT

Figure 2:
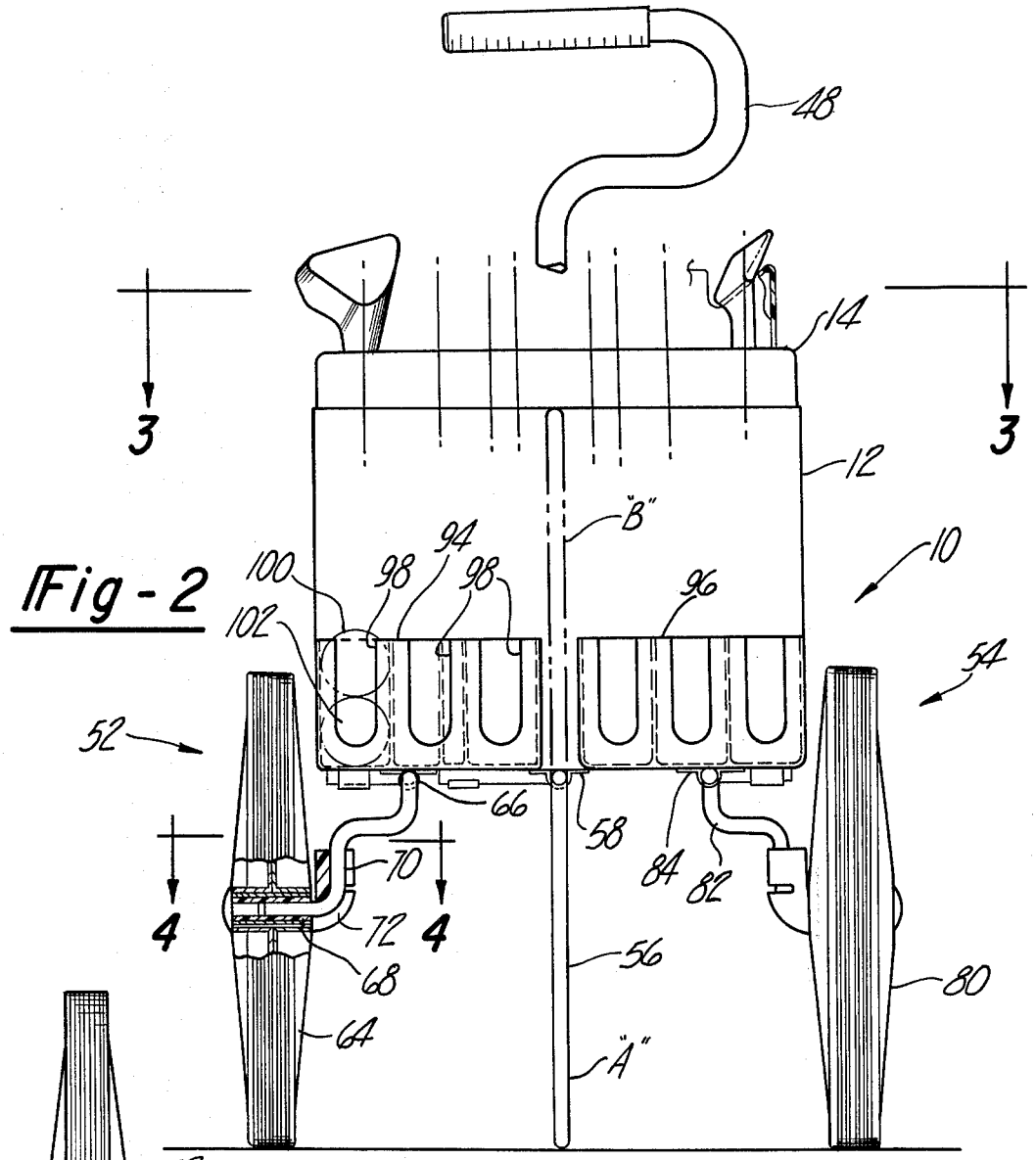
FIG. 2 is a view as seen from the right side of FIG. 1.
Figure 3:
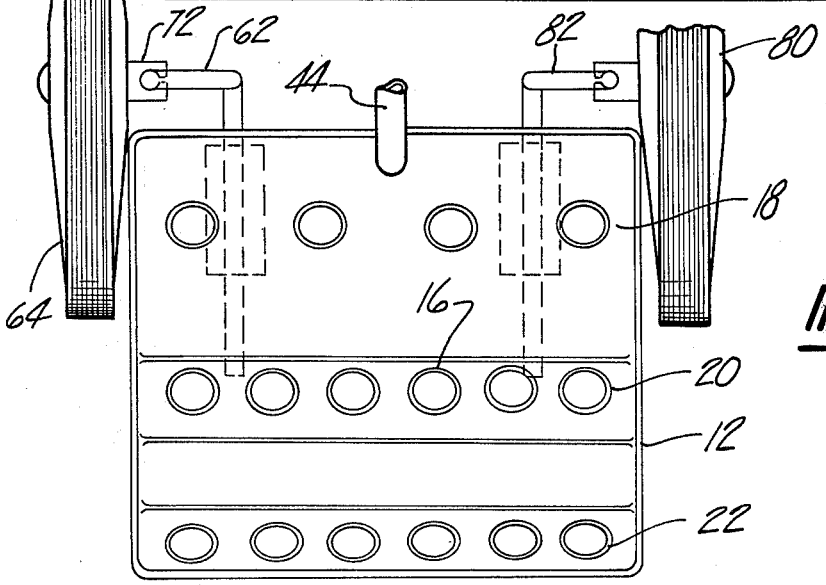
FIG. 3 is a view of the preferred cart taken along lines 3—3 of FIG. 2.

Now referring to the drawings, FIGS. 1 and 2 illustrate a preferred cart 10 as comprising a tube-shaped body 12, and a cover 14 mounted on body 12. Cover 14 has a set of sixteen openings arranged in rows 18, 20, and 22. As best illustrated in FIG. 1, a tubular member 24 is seated in each opening of row 22, a second, shorter tubular member 26 is seated in each opening of row 20, and a shorter tubular member 28 is seated in each opening of row 22.

A base member 30 is mounted inside body 12 and has a step 32 supporting the bottom of tube members 24. A second step 34 supports the bottom of tube members 26, and a top step 36 supports the bottom of tube members 28.

A second stepped member 38 is mounted in the body to locate tubular members 24, 26, and 28 in their respective positions in the body. Body 12 and cover 14 define a side opening 40. A socket 42 is mounted in the body adjacent opening 40. Short tube 44 is mounted in the socket and carries an expandable strap 46. A tubular handle 48 is received in tube 44 in a close fitting relationship. A wing nut fastener 50 mounted on strap 46 allows the user to clamp handle 48 to tube 44. When the golf cart is to be stored, the wing nut is loosened to release handle 48.

Still referring to FIGS. 1 and 2, wheel means 52 ad wheels means 54 are mounted on opposite sides of cart body 12 beneath handle 48. A balance leg 56 is mounted on the bottom of body 12 opposite the wheel means to cooperate in supporting the cart in an upright position.

Referring to FIGS. 1 and 2, a U-shaped retainer 58 is attached to the bottom of body 12 to slidably support balance leg 56. Balance leg 56, as illustrated in FIG. 1, can be swung from its lower position illustrated at A to an upper position illustrated in phantom at B, and then slid toward a stored position adjacent body 12 illustrated at C in which it is connected to a second retainer 60 which holds the leg in its stored position.

Wheel means 52 comprises an axle 62 and a groundengaging wheel 64. A retainer 66 slidably engages one end of axle 62 and a bushing 68, carried by wheel 64, slidably receives the opposite end of axle 62. Axle 62 has a vertical section 70 received in a split portion 72 of bushing 68 which permits the user to remove wheel 64 from the axle by pulling the wheel away from the end of the axle. To mount the wheel on the axle, the user slips the end of the axle into the bushing until the split portion 72 snaps on the vertical section 70 of the axle.

For storage purposes, when wheel 64 has been removed from axle 62, the axle can then be slidably swung from its lower position to its upper position as illustrated at D in FIG. 1 and then pushed toward a stored position at E in which it is adjacent body 12 and retained in its stored position by retainer 74. In its lower position, axle 62 has an end 76 seated in a retainer 78 attached to the bottom of body 12. To swing the axle from its downward position toward its stored position, the user pulls the axle away from retainer 78, then swings the lower axle end to position D and then pushes it into retainer 74.

Wheel means 54 comprises a wheel 80 identical to wheel 64, and an axle 82 connected to body 12 by retainers 84 and 86 in a manner similar to the manner in which axle 62 is mounted. Axle 82 can also be disconnected from wheel 80 and then swung into an upper position in which it is retained in a position closely adjacent body 12.

Referring to FIG. 1, a retainer 90 is attached to body 12 above leg 56 for supporting a plurality of tees 92. A pair of ball housings 94 and 96 are attached to the lower part of body 12 below retainer 90. Each of the housings 94 and 96 have three vertical slots 98 each adapted to receive a pair of conventional golf balls 100 and 102. The upper end of housings 94 and 96 is tapered inwardly at 104 to form a top opening that is slightly smaller than the golf ball so that they can be readily snapped out of their housing for use.

Body 12 is adapted to support a full set of detachable heads, for example, clubs 104, 106, and 108. Each head has a shank having a length which depends upon the nature of the head. For example, head 104 has a shank 110 which is longer than the shank 112 attached to club 106 which in turn is longer than shank 114 attached to club 108.

Referring to FIGS. 5–7, a shaft 116 having a handle 118 is adapted to be connected to a typical head 106 having a shank 112. A sleeve 120 is carried on shaft 116 opposite handle 118, and has a opening 122 for receiving shank 112. Preferably opening 122 has a hexagonal bore and shank 112 has a head 113 with a hexagonal cross-section so that it mates with opening 122 so as to be locked against rotation with respect to the shaft. Typical shank 112 has a transverse slot 124 aligned with an opening 126 carried in sleeve 120. The shank also has a tapered end 128 to assist the user in joining the shank to the sleeve.

A latch 130 is mounted on the sleeve and has a tongue 132 which is received in opening 126 and slot 124 to lock the shank to the sleeve.

Tongue 132 has a slope 134 which engages the tapered end 128 of the shank as it is being received. A pair of resilient pressure bands 136 and 138 embrace sleeve 120 and latch 130 on opposite sides of opening 126 to bias tongue 132 toward opening 126.

A release member 140 is attached to latch 130 such that the user can move the release member toward the sleeve to remove tongue 132 from groove 124. The release member is normally spaced from sleeve 120 as illustrated in FIG. 6. By moving the release member against the bias of bands 136 and 138 and toward sleeve 120, tongue 132 is moved toward the right until it is removed from slot 124 in shank 112. When the user removes pressure from the release member, pressure bands 136 and 138 return the latch toward its locking position in the sleeve.

A detent means 144 is mounted in sleeve 120 adjacent the end of the shaft 116 and has a spring-biased detent element 146 engaging the end of shank 112 to bias it toward a snug engagement with latch tongue 132.

Thus it can be seen that I have described a novel golf cart assembly that can be easily collapsed by removing the wheels from the axles and then swinging both the axles as well as the balance leg to a position closely adjacent the cart body. The cart accommodates a full set of detachable heads each of which is substantially reduced from the conventional club length by employing a shank for each head which can be easily connected to a common shaft. The length of the shank of each head accomodates the particular head so that when joined to the shaft, the combined shaft and head has a conventional overall length. In addition, I have described a novel means for detaching the head from the shaft so that the user can release the shaft by merely pressing on the release member.

Having described my invention, I claim:

1. A golf club, comprising:

a head having a elongated shank, and a latch-receiving opening in the shaft;

an elongated shaft having a handle on one end thereof, an axial opening in the opposite end thereof for receiving the shank, and a shaft opening which registers with the latch-receiving opening of the shank when it is disposed in the axial opening of the shaft;

a latch mounted on the shaft on one side thereof so as to be movable in a lateral direction with respect to the longitudinal axis of the shaft, between a latched position in which the latch is disposed in the shaft opening and the latch-receiving opening of the shank to prevent longitudinal motion of the shank with respect to the shaft, and a release position in which the latch is removed from the latch–receiving opening in the shank to permit longitudinal motion of the shank with respect to the shaft;

release means mounted on the shaft on the opposite side thereof as the latch, the release means being movable in a lateral direction with respect to the shaft and being connected to the latch so as to be movable therewith;

a resilient band embracing the shaft and being so connected to the latch as to bias it toward said latched position whereby the release means are operable to move the latch toward said release position for removing the shank from the axial opening of the shaft; and the shank having a tapered end for engaging the latch for moving it toward said release position as the shank is being received into the axial opening in the shaft.

2. A golf club as defined in claim 1, including a second resilient means in the shaft for biasing the shank in a direction toward removal from the shank-receiving opening.

3. A golf club as defined in claim 1, including a second head having a shank receivable in the axial opening of the shaft.

4. A golf club as defined in claim 1, in which the latch has a beveled slope for engaging the shank as it is being received in the shaft.

* * * * *